United States Patent [19]

Saito et al.

[11] Patent Number: 4,601,052

[45] Date of Patent: Jul. 15, 1986

[54] VOICE ANALYSIS COMPOSING METHOD

[75] Inventors: Hiroshi Saito, Katano; Kiyotaka Nagai; Daisuke Mori, both of Hirakata; Masahiko Hatanaka, Moriguchi; Hideo Shibuya; Tomoaki Abe, both of Yokohama; Minoru Toyoda, Tokyo, all of Japan

[73] Assignee: Matsushita Electric Industrial Co., Ltd., Kadoma, Japan

[21] Appl. No.: 447,899

[22] Filed: Dec. 8, 1982

[30] Foreign Application Priority Data

| | | | |
|---|---|---|---|
| Dec. 17, 1981 | [JP] | Japan | 56-203932 |
| Dec. 17, 1981 | [JP] | Japan | 56-203933 |
| Dec. 17, 1981 | [JP] | Japan | 56-203934 |

[51] Int. Cl.[4] ..... G10L 1/00

[52] U.S. Cl. ..... 381/51; 84/1.21

[58] Field of Search ..... 381/29–53; 364/513, 513.5; 84/1.21

[56] References Cited

U.S. PATENT DOCUMENTS

| | | | |
|---|---|---|---|
| 3,104,284 | 7/1963 | French et al. | 381/34 |
| 3,588,353 | 6/1971 | Martin | 381/51 |
| 3,892,919 | 7/1975 | Ichikawa | 381/51 |
| 4,227,435 | 4/1978 | Ando et al. | 84/1.19 |
| 4,328,395 | 5/1982 | Henderson | 381/51 |

*Primary Examiner*—E. S. Matt Kemeny

*Attorney, Agent, or Firm*—Wenderoth, Lind & Ponack

[57] ABSTRACT

In a speech analysis and synthesis (composing) method, a phoneme transition waveform is generated to smoothly couple phoneme PHA to PHB having different pitch periods. The method involves obtaining the differential value (difference phoneme ΔPH or difference phoneme ΔPHI and difference clock or pitch period), and in composition merely adding phoneme PHA and difference phoneme ΔPHI and clock period and difference clock period.

10 Claims, 10 Drawing Figures

VOICE ANALYSIS COMPOSING METHOD

BACKGROUND OF THE INVENTION

The present invention relates to a voice analysis composing method, and more particularly to a voice analysis composing method of a phonemic piece editing type.

Generally the voice analysis composing method of a phonemic piece editing type comprises the steps of extracting, in pitch units, the representative phonemic piece data from the raw voice signal in accordance with the strong similarity among the adjacent waveforms of the voiced sound, sequentially connecting the extracted phonemic piece data while repeating the extracted phonemic piece data a plurality of times in accordance with the voiced composition controlling information, and editing the phonemic piece data to compose the desired voice signal. As an example, FIG. 1 shows one portion of the voice signal waveform composed by the voice analysis composing method of a phonemic piece editing type. The signal of FIG. 1 is a voice signal provided by a three-time repetition of the phonemic piece PHA, a connection to the phonemic piece PHB and a two-time repetition of the phonemic piece PHB.

Since the voice analysis composing method of the phonemic piece editing type composes a voice signal by the sequential connection of the phonemic piece data in accordance with the voice composition controlling information, the voice analysis composing method thereof is simplified in its composing procedure as compared with the parameter analysis composing method such as PARCOR system, LSP system, Formant composing system or the like, whereby the voice composition can be easily realized by the use of a general purpose micro-processor or the like.

However, this method had a problem in that periodical noise sounds were caused due to the repetition of the phonemic piece, thus rendering it difficult to provide a smooth voice signal, since the waveforms and the pitch periods of the phonemic piece changed abruptly in the connection point of the different phonemic pieces as shown in FIG. 1.

To improve such problems, the insertion of the interpolation phonemic piece to be provided by the interpolating operation between two phonemic pieces was hitherto proposed.

Namely, the ith data value PHI (i) of the interpolation phonemic piece PHI of the preceding phonemic piece PHA and the succeeding phonemic piece PHB is obtained from the following equation (1), wherein the ith data value of the preceding phonemic piece PHA of the phonemeric piece data group provided by the sampling operation of the voice signal at the given sampling period is assumed to be PHA (i) ($i=1, 2, \ldots, N_A$, wherein the $N_A$ is the data number of the PHA), the ith data value of the succeeding phonemic piece PHB is assumed to be PHB (i) ($i=1, 2, \ldots, N_B$, wherein the $N_B$ is the data number of the PHB), $$\mathrm{PHI}\ (i)=f\{\mathrm{PHA}\ (i), \mathrm{PHB}\ (i)\} \tag{1}$$

In the equation (1), the f (A, B) is the interpolation functions of the two phonemic piece data A, B.

The interpolation of two phonemic piece data is adapted to be obtained by the linear interpolation. Assume that the number of the interpolation phonemic piece to be inserted into between two phonemic pieces is M, and the ith data value PHI (i, j) of the jth interpolation phonemic piece can be obtained from the following equation (2)

$$PHI\ (i, j) = \left(1 - \frac{j}{M+1}\right) PHA\ (i) + \frac{j}{M+1} \cdot PHB\ (i) \tag{2}$$

Since the data value PHB (i) of the succeeding phonemic piece can be provided through a condition of ($j=M+1$) in the equation (2), the PHB can be called an interpolation phonemic piece in a broad sense. Also, assume that M′ to be defined in the following equation (3) is called An "interpolation repeating number." The equation (2) can be represented in the equation (4) when the M′ is used.

$$M' = M + 1 \tag{3}$$

$$PHI\ (i, j) = \left(1 - \frac{j}{M'}\right) PHA\ (i) + \frac{j}{M'} \cdot PHB\ (i) \tag{4}$$

wherein $j=1, 2, \ldots, M'$.

A problem of the conventional method was in the processing method of the phonemic piece data in the calculation of the phonemic piece data of the interpolation phonemic piece in accordance with the equation (1) or the equation (2), since the phonemic pieces were generally different in respective pitch periods and thus the data number $N_A$ of the phonemic piece PHA was different in value from the data number $N_B$ of the phonemic piece PHB. In this case, the phonemic piece data of the interpolation phonemic piece is obtained after the data number of two phonemic pieces has been rendered equal by addition of the final data value or zero data to the phonemic piece data, which has a lower data number.

To obtain the smooth, natural voice signal, the pitch period is required to be smoothly varied. Accordingly, the data number $N_I$ of the interpolation phonemic piece is obtained through an interpolation operation as shown in the equation (5) from the data number $N_A$ of the preceding phonemic piece PHA and the data number $N_B$ of the succeeding phonemic piece PHB.

$$N_I=\mathrm{INT}\{g\ (N_A, N_B)\} \tag{5}$$

wherein the g ($N_A$, $N_B$) is the interpolation function of two data numbers $N_A$, $N_B$, and the INT (x) is the function for rendering x equal to the nearest integer.

The data number of the interpolation phonemic piece is obtained by a linear interpolation. When N is the number of the interpolation phonemic pieces to be inserted between two phonemic pieces, the data number $N_I(j)$ of the jth interpolation phonemic piece is given by the following equation (6).

$$N_I(j) = INT\left\{\left(1 - \frac{j}{M+1}\right) NA + \left(\frac{j}{M+1}\right) N_B\right\} \tag{6}$$

wherein $j=1, 2, \ldots, M+1$.

Accordingly, the pitch period can be smoothly varied by a method of outputting, by the number of the data obtained by the interpolation, the phonemic piece data obtained as described hereinabove so as to cut off the remaining data.

However, in this method, the remaining data of the interpolation phonemic piece was obliged to be cut off and thus noise was caused due to the cutting-off operation.

FIG. 2, (*b*) shows as interpolation phonemic piece PHI, obtained from the phonemic piece PHA shown in FIG. 2, (*a*) and the phonemic piece PHB shown in FIG. 2, (*b*), by a conventional method.

In FIGS. 2(*a*)-(*c*), the interpolation phonemic piece PHI is a phonemic piece to be inserted into the middle portion of the phonemic piece PHA and the phonemic piece PHB. The data value and the data number of the interpolation phonemic piece are both obtained by a linear interpolation.

Since the final data value of the interpolation phonemic piece is not zero as shown in FIG. 2, (*b*), this fact causes the noise sounds.

In FIG. 2(*a*)-(*c*), $\tau$ is the clock period when the data is sampled, i is the sample data number, t is time, $N_A$ and $N_B$ are respective data numbers of the phonemic pieces PHA and PHB.

SUMMARY OF THE INVENTION

The present invention has, accordingly, for its essential object to provide an improved voice analysis composing method substantially free from the above discussed disadvantages and inconveniences inherent in the prior art voice analysis composing method.

Accordingly, a principal object of the present invention is to provide a voice analysis composing method of a phonemic editing type, which is capable of composing voice signals which are smooth and natural in the phonemic piece waveform and pitch period.

Another object of the present invention is to provide a voice analysis composing method, which can realize a compact voice composing apparatus wherein the compression rate of the voice data is high, the memory capacity for storing the voice data is small.

A further object of the present invention is to provide a voice analysis composing method, which is capable of composing the natural voice by a simple controlling circuit such as general-purpose micro-computer.

According to the present invention, a voice analysis and composing method is provided comprising a voice analysis method including; (a) a step of rendering a data number of phonemic data equal to the a given data number in a phonemic piece for interpolation between two phonemic pieces; (b) a step of composing phonemic piece data of the interpolation phonemic piece, by an interpolation operation, from the same data number value of the phonemic piece data of the phonemic piece preceding the phonemic piece to be interpolated and the succeeding phonemic piece; (c) a step of obtaining a phonemic piece data string of a phonemic piece group including the interpolation phonemic piece through insertion of the phonemic piece data of said interpolation phonemic piece into the phonemic piece data of the phonemic piece data to be interpolated; (d) a step of obtaining a difference phonemic piece data string through provision of the difference of the same-number data value of the adjacent phonemic piece data of said phonemic piece data string; (e) a step of storing, in a from said memory so as to thereby obtain the phonemic piece data strings of the phonemic piece group including the interpolation phonemic pieces; (g) a step of effecting the interpolation operation from the clock period of the phonemic piece preceding said phonemic piece to be interpolated and the clock period of the succeeding phonemic piece so as to thereby produce the clock period of the interpolation phonemic piece; (h) a step of inserting the clock period of said interpolation phonemic piece into the clock period of the phonemic piece to be interpolated to obtain the clock period strings of the phonemic piece group including the interpolation phonemic pieces; and (i) a step of outputting, by said clock period string, the phonemic piece data string of the phonemic piece group including said interpolation phonemic pieces.

These objects and other objects, features, aspects and advantages of the present invention will become more apparent from the following detailed description of the present invention when taken in conjunction with the accompanying drawings.

DESCRIPTION OF THE REFERRED EMBODIMENTS

Figure 1:
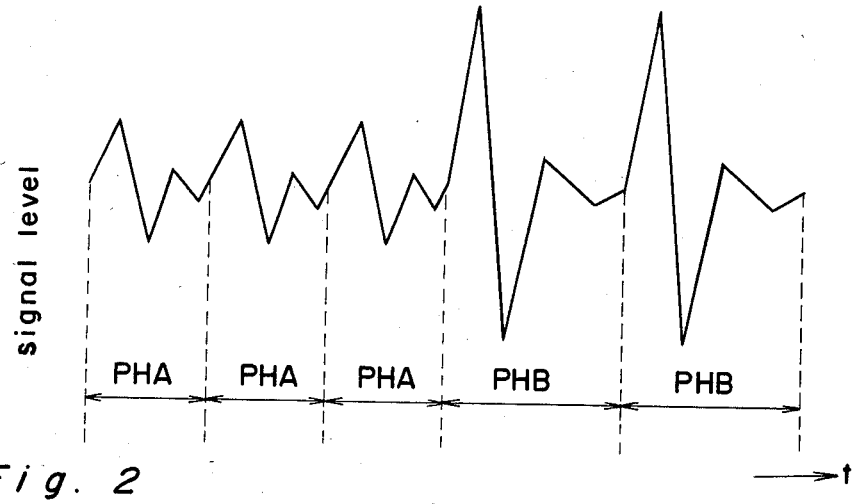
FIG. 1 is a view showing one portion of the waveforms composed by a voice analysis composing method of a phonemic piece editing type.

In the voice analysis composing method of the present invention, at first the number of the data is rendered equal to the given number N of the data in terms of phonemic piece data of the phonemic pieces for interpolation between two phonemic pieces.

In principle, to render equal the number of the data of the phonemic pieces each having a different pitch period, a sampling operation is required while varying the clock period in the sampling of the phonemic pieces so that the number of the data of the phonemic pieces may become constant. However, since it is extremely difficult to vary the sampling clock period of the phonemic pieces in accordance with the pitch period, the interpolation or decimation of the data is performed by a method such as that described in detail in an article entitled: "Interpolation And Decimation of Digital Sigis reduced or increased to provide the given number of the data.

The interpolating operation is performed in accordance with an equation (1) or an equation (2) from the ith data value PHA (i) (i=1, 2, . . . , N) of the preceding phonemic piece PHA of the phonemic piece data which has become a constant data number, and the ith data value PHB (i) (i=1, 2, . . . , N) of the succeeding phonemic piece PHB thereby so as to provide the ith data value PHI (i) (i=1, 2, . . . , N) of the interpolating phonemic piece PHI.

In accordance with the method of the present invention, the number of the data of the phonemic piece to be interpolated is constant. Thus, as in the conventional method, a final data value or a zero data value is not required to be added artifically to the phonemic piece data of a lower data number.

The phonemic piece data of the interpolating phonemic piece provided as described hereinabove is inserted into the phonemic piece data of the phonemic piece to be interpolated so as to provide the phonemic piece data string of a phonemic piece group including the interpolating phonemic piece.

To compose the desired voice signal, the phonemic piece data string of a phonemic piece group including the interpolation phonemic pieces may be provided by the interpolating operation from the phonemic piece data of the preceding phonemic piece of data and of the succeeding phonemic piece of data, as described hereinabove. Such an interpolating operation as described hereinabove is performed in advance. The difference of the same-number data value of the adjacent phonemic piece data of the phonemic piece data string of a phonemic piece group including the interpolating phonemic pieces is provided to obtain the difference phonemic piece data string. When it is stored in a memory, the phonemic piece data string of the phonemic piece group including the interpolating phonemic pieces can be obtained by an adding operation only during the voice composition. Thus, the operation of obtaining the phonemic piece data string during the voice composition can be reduced.

The difference phonemic piece data ΔPH (i, j) between a (j−1) phonemic piece data and a jth phonemic piece data is given in an equation (7) wherein the ith data value of the jth phonemic piece data (j=0 gives a number to the phonemic piece data sequentially from zero as representing the lead phonemic piece data) of the phonemic piece data string of the phonemic piece group including the interpolating phonemic piece is PH (i, j).

$$\Delta PH(i, j) = PH(i, j) - PH(i, j-1) \tag{7}$$

wherein i=1, 2, . . . , N.

It is to be noted that the difference in the present method is different, in terms of how to obtain the difference, from the difference in the DPCM method. Namely, in the DPCM method, the difference between the adjacent sample data is taken, while in the difference of the present present method, the difference between the sample data corresponding to the adjacent phonemic pieces is taken as shown in the equation (7).

Then, the lead phonemic piece data of the phonemic piece data string, and the difference phonemic piece data string are stored in the memory.

The equation (8) is established from the equation (7).

$$PH(i, j) = PH(i, 0) + \sum_{k=1}^{j} \Delta PH(i, k) \tag{8}$$

To obtain the phonemic piece data string of a phonemic piece group including the interpolation phonemic pieces in composing voice signals from the equation (8), it has been found that the difference phonemic piece data read from the above-described memory is required to be sequentially added to the lead phonemic piece data of the phonemic piece data string read from the above described memory.

The adoption of the interpolation method of the difference phonemic piece data causes the following merits.

Namely, since the phonemic piece data string of a phonemic piece group including the interpolation phonemic pieces is provided only by the adding operation in composing the voice signals, it can be realized by such a simple controlling circuit as a general-purpose micro-computer. The natural voice can thereby be composed by a simple circuit construction.

To obtain the phonemic piece data of the interpolation method phonemic piece by the linear interpolation, the ith difference data value ΔPHI (i) of the jth interpolation phonemic pieces PHI between two phonemic pieces is given in the equation (9).

$$\Delta PHI(i) = \frac{PHB(i) - PHA(i)}{M + 1} \tag{9}$$

wherein the ith data value of the preceding phonemic piece PHA preceding the phonemic piece to be interpolated is PHA (i), and wherein the number of the interpolation phonemic pieces to be inserted between two phonemic pieces is M, j=1, 2, . . . , M+1.

Stated another way, in order to obtain the difference phonemic piece data by the linear interpolation method in the unit of phonemic pieces (referred to merely as the linear interpolation method hereinafter), the interpolation waveform may be obtained only by calculating PHI to be represented by the equations shown below.

$$PHA(i) = PH(i,o)$$

$$PHB(i) = PH(i, M+1)$$

$$\Delta PHI(i) = \frac{PHB(i) - PHA(i)}{M + 1}$$

$$\Delta PHI(i) = \Delta PH(i,1) = \Delta PH(i,2) = \ldots = \Delta PH(i,j)$$

$$i = 1,2, \ldots, N$$

$$j = 1.2, \ldots, M+1$$

wherein the ith data value of the preceding phonemic piece PHA of the phonetic piece to be interpolated is PHA(i), the ith data value of the succeeding phonemic piece PHB of the phonetic piece to be interpolated is PHB(i), and the number of the interpolation phonemic pieces to be inserted between two phonemic pieces is M, j=1, 2, . . . , M+1.

In the linear interpolation, the value of the difference phonemic piece data becomes constant between two phonemic pieces to be interpolated as shown in the equation (9). A value, wherein 1 is added to the number of the interpolation phonemic pieces to be inserted between the phonemic pieces to be interpolated, the lead phonemic piece data of the phonemic piece data of the phonemic piece to be interpolated, and a difference phonemic piece data provided through division, by a value wherein 1 is added to the number of the interpolation phonemic pieces, of the difference of the same-number of data value of the phonemic piece data of the preceding phonemic piece and the succeeding phonemic piece to be interpolated are required to be stored in the memory.

To obtain the phonemic piece data string of a phonemic piece group including the interpolation phonemic piece composing the desired voice signal, such as PHB(i), the leading phonemic piece data PHA(i) of the phonemic piece data read in series from the memory 3 is repeatedly added with the difference phonemic piece data ΔPHI, also read from the memory 3, for a number of times equal to the sum of the number M of the interpolation phonemic piece read from the memory 3 plus one. This can be understood from the equation (9) given above.

Since the lead phonemic piece of a phonemic piece group is stored as is as a phonemic piece data in the general interpolating method by the difference phonemic piece data, the difference phonemic piece data requires a value, wherein the number of the interpolation phonemic pieces has been added to the number of the phonemic pieces to be interpolated, i.e., the number, wherein 1 has been subtracted from the number of the phonemic pieces of a phonemic piece. However, in the linear interpolation method, the difference phonemic piece data requires only the number provided by subtraction of 1 from the number of the phonemic pieces to be interpolated. Thus, the memory capacity, if small, for storing the difference phonemic piece data will suffice.

Also, the smooth variation in the pitch period of the composite voice signal is performed by the smooth variation in the clock period when the phonemic piece data string of a phonemic piece group including the interpolation phonemic pieces is outputted.

Namely, when the clock period of the phonemic piece PHA preceding the phonemic piece to be interpolated is $\tau_A$, and that of the succeeding phonemic piece PHB is $\tau_B$, the clock period $\tau_I$ of the interpolation is calculated from the equation (10).

$$\tau_I = h(\tau_A, \tau_B) \tag{10}$$

wherein the h ($\tau_A$, $\tau_B$) is an interpolation function of two clock periods $\tau_A$, $\tau_B$.

Assume that M is the number of the interpolation phonemic pieces to be inserted between two phonemic pieces when the clock period of the interpolation phonemic piece is obtained by the linear interpolation method, and the clock period $\tau_1$ (i) of a jth interpolation phonemic piece is given by the equation (11), $$\tau_I(j) = \left(1 - \frac{j}{M+1}\right) \cdot \tau_A + \frac{j}{M+1} \cdot \tau_B \tag{11}$$

wherein j=1, 2, . . . , M+1.

Then, the clock period of the interpolation phonemic piece is inserted into the clock period of the phonemic piece to be interpolated so as to obtain the clock period strings of a phonemic piece group including the interpolation phonemic pieces.

In the outputting operation of the voice signals, the clock period strings of the phonemic piece group including the interpolation phonemic pieces during the interpolation operation of the clock period is as described. The use of the method for obtaining the difference clock period can reduce the operation for obtaining the clock period string during the voice outputting operation.

Namely, the difference clock period string is provided by the provision of the difference of the adjacent clock periods of the clock period strings of phonemic piece groups including the interpolation phonemic pieces obtained as described hereinabove.

Then, the lead clock period of the clock period strings and the difference clock period strings are stored in the memory.

To obtain the clock period strings of the phonemic piece group including the interpolation phonemic pieces in the composition of the voice signal, the difference clock period read from the memory is required to be sequentially added to the lead clock period of the clock period strings read from the memory.

Through the adoption of the interpolation method using such a difference clock period, the clock period strings of the phonemic piece group including the interpolation phonemic pieces can be obtained by only the adding operation, thus reducing the operation for obtaining the clock period strings during the phonemic composition.

Also, since the difference clock period becomes constant between two phonemic pieces to be interpolated when the clock period is obtained by the linear interpolation method, a value, wherein 1 has been added to the number of the interpolation phonemic pieces to be inserted among the phonemic pieces to be interpolated, and a difference clock period provided through division, by a value wherein 1 has been added to the number of the interpolation phonemic pieces, of the difference of the clock period of the lead phonemic piece of the phonemic pieces to be interpolated, the clock period of the phonemic piece preceding of the phonemic pieces to be interpolated, and the clock period of the succeeding phonemic piece are stored in the memory.

To obtain the clock period strings of the phonemic piece group including the interpolation phonemic pieces in the composition of the desired voice signal, the number of the value wherein 1 has been added to the number of the interpolation phonemic pieces read from the memory, the difference clock period read from the memory is required to be added to the clock period of the lead phonemic piece of the phonemic pieces to be interpolated read read from the memory.

As in the linear interpolation of the difference phonemic piece data, the memory capacity may be rendered smaller in the linear interpolation of the difference clock period as compared with in the general interpolation. Also, as the clock period generally changes smoothly, the dynamic range becomes smaller in the difference clock period value as compared with the clock period value. Accordingly, since the number of digital bits can be rendered even smaller, the memory capacity can be rendered even smaller from this point.

According to the present invention, the number of the given data of the phonemic piece data is further varied for each of the phonemic piece groups to compress the phonemic piece data.

A case will be considered where a natural voice in which the pitch frequency is varying in a range of 200

Hz through 400 Hz is sampled by the frequency of 10 kHz.

In this case, the number of the data of the phonemic piece of 200 Hz in pitch frequency becomes 50, and the number of the data of the phonemic piece of 400 Hz in pitch frequency becomes 25.

Then, according to the system of the present invention, the number of the data of the phonemic pieces is converted into the number of the given data, 40 here.

Accordingly, the clock frequency when the pitch frequency outputs the phonemic piece of 200 Hz becomes $200\times40=8{,}000$ Hz, i.e., 8 kHz. Similarly, the clock frequency when the pitch frequency outputs the phonemic piece of 400 Hz becomes 16 kHz.

When the data sampling is performed with the frequency of 10 kHz in accordance with sampling theorem, the component of the frequency of 5 kHz causes false signals. Thus, the low-pass filter is used for interruption.

Accordingly, even if the clock frequency in the outputting operation is rendered 16 kHz, the component of the frequency of 5 kHz through 8 kHz does not exist in the outputting phonemic piece. Thus, no merits are caused due to higher clock frequency during the outputting operation.

Namely, the outputting operation of the phonemic pieces of 400 Hz in pitch frequency with the data number 40 and the clock frequency 16 kHz is equivalent to the outputting operation of the same phonemic piece with the data number 25 and the clock frequency 10 kHz.

Accordingly, the phonemic piece of 200 Hz in pitch frequency is required to be outputted with the data number 40 and the clock frequency 8 kHz. Also, the phonemic piece of 400 Hz is required to be outputted with the data number 25 and the clock frequency 10 kHz.

In the case of the phonemic piece of large pitch frequency, the data number of the phonemic piece can be selected so as to be smaller to thereby reduce the number of the phonemic piece data so that the clock frequency during the outputting operation can be rendered smaller.

As described hereinabove, the number of the data of the phonemic piece can be varied by the phonemic piece group to render the memory capacity smaller yet capable of storing the phonemic piece data. Also, the clock frequency during the voice outputting operation is rendered smaller so as to lengthen the processing time taken until the next output.

Figure 3:
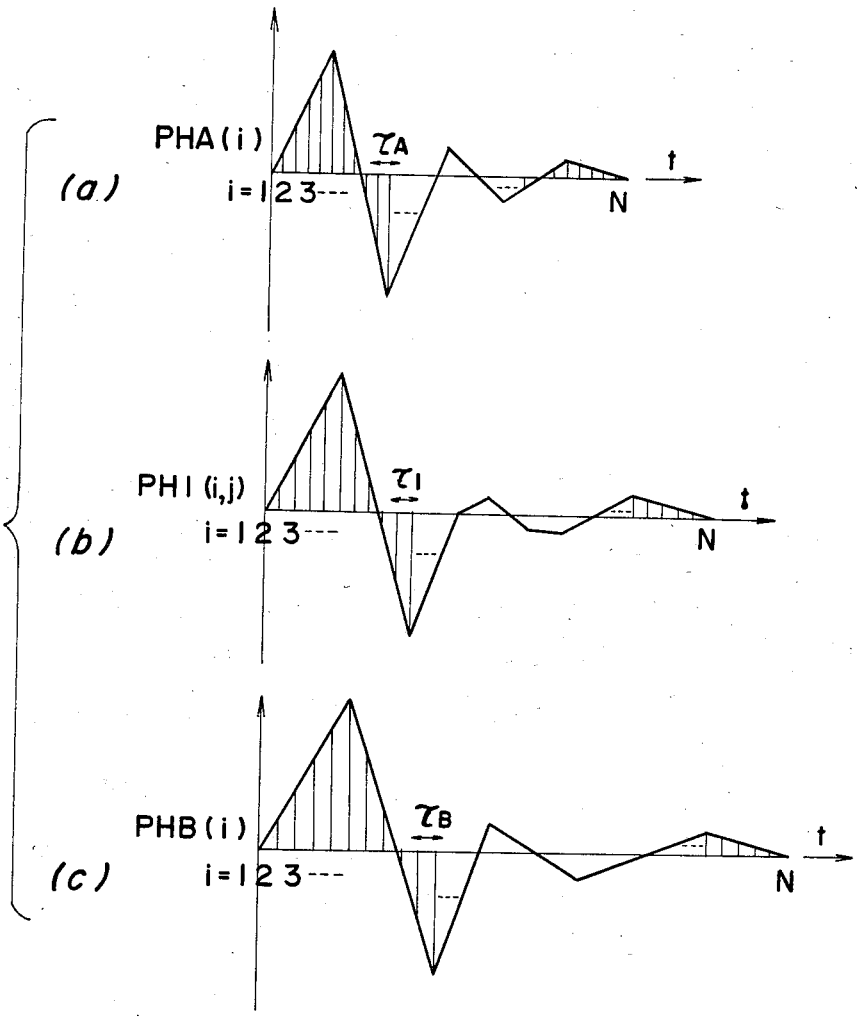
FIGS. 3, (*a*), (*b*), (*c*) are waveform views for illustrating a phonemic piece interpolating method, which is suitable to the voice analysis composing method of a phonemic piece editing type in accordance with the present invention.

FIG. 3 (*b*) shows an interpolation phonemic piece PHI, which is obtained from the phonemic piece PHA shown in FIG. 3 (*a*) and from the phonemic piece PHB shown in FIG. 3 (*c*) by the interpolation of the method in accordance with the present invention.

Figure 2:
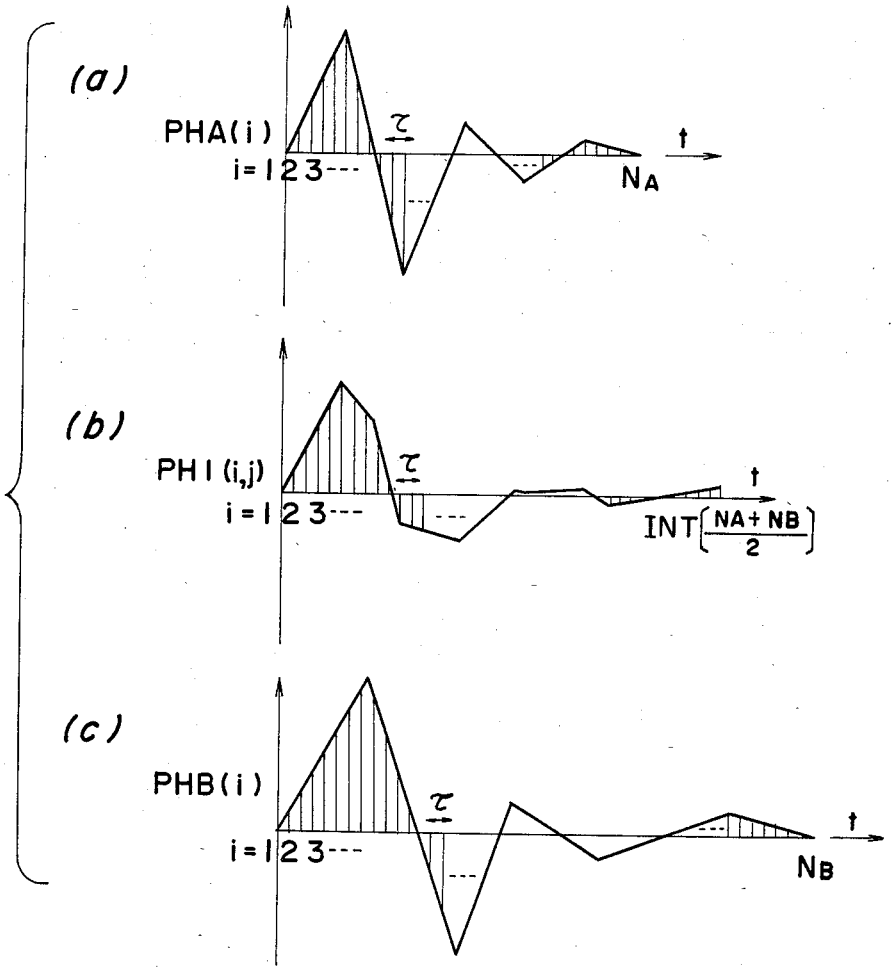
FIGS. 2, (*a*), (*b*), (*c*) are waveform views for illustrating the conventional phonemic piece interpolating method.

FIGS. 3(*a*)–(c) are shown corresponding to FIGS. 2(*a*)–(*c*) and the waveforms in FIGS. 3 (*a*), (*c*) respectively correspond to the waveforms of FIGS. 2 (*a*), (*c*), but are different in their sampling clock period. In FIGS. 3(*a*)–(*c*), the interpolation phonemic piece PHI is a phonemic piece to be inserted into the middle between the phonemic piece PHA and the phonemic piece PHB. The data value of the interpolation phonemic piece and the sampling clock period are both obtained by the linear interpolation.

As apparent from FIG. 3 (*b*), according to the interpolation method by the present invention, the abrupt change in the waveform of the terminal portion due to the closeness of the data of the interpolation phonemic piece, seen in FIG. 2 (*b*) of the conventional method, is not caused. Thus, noise is not caused as in the conventional method, thus resulting in natural, smooth composite voice.

In FIGS. 3(*a*)–(*c*), $\tau_A$, $\tau_I$, $\tau_B$ are clock periods corresponding, respectively, to the phonemic pieces PHA, PHI, PHB, the i shows the sample data number, N shows the number of the data. In the above-described illustration, only the interpolation method in accordance with the present invention has been illustrated. Needless to say, the desired voice signal can be provided by the combination of the phonemic piece of the interpolation operation effected and the conventional phonemic piece of the interpolation not effected and the subsequent connection of them.

Figure 4:
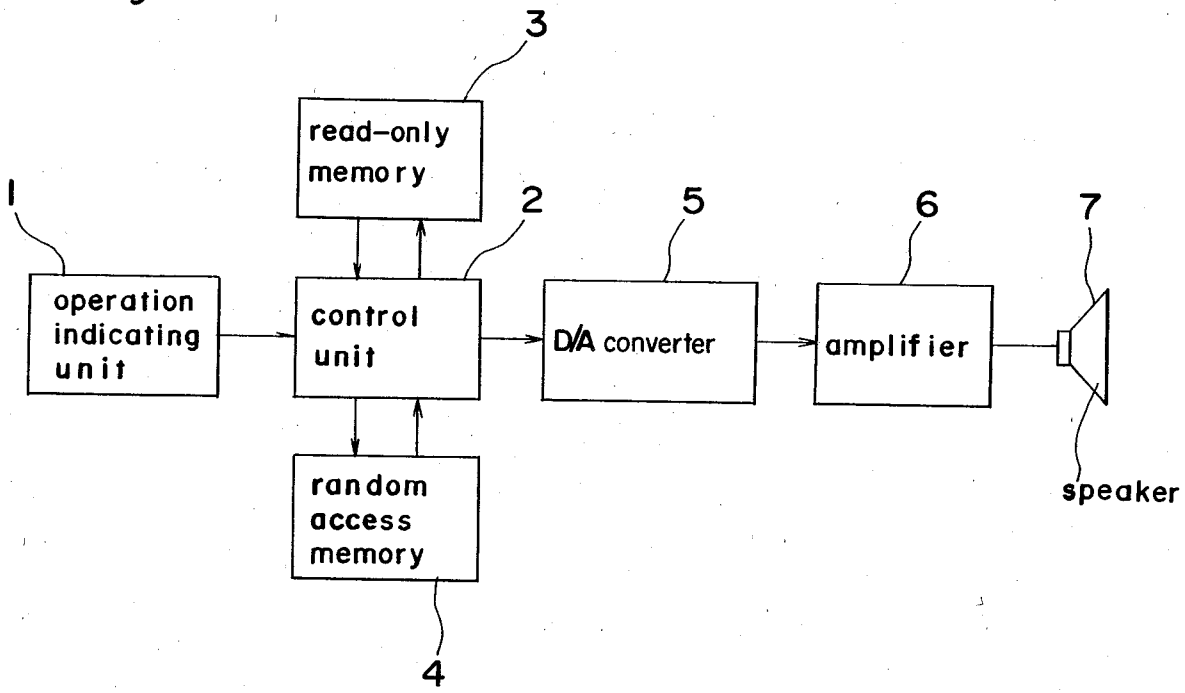
FIG. 4 is a block diagram, in one embodiment, of a voice composing apparatus for realizing the voice analysis composing method in accordance with the present invention.

FIG. 4 shows a block diagram, in one embodiment, of a voice composing apparatus for realizing the voice analysis composing method in accordance with the present invention.

In FIG. 4, reference numeral 1 is an operation indicating unit wherein the operator indicates a voice and operation mode. Reference numeral 2 is a control unit such as general-purpose micro-computer or the like. Reference numeral 3 is a read only memory (ROM) for storing a voice producing program, phonemic piece data, etc. Reference numeral 4 is a random access memory (RAM) for temporarily storing the necessary data during the execution of the program or for other uses. Reference numeral 5 is a D/C converter for converting the digital signals into analog signals. Reference numeral 6 is an amplifier, and reference numeral 7 is a speaker.

The operation of the voice composing apparatus will be described hereinafter with reference to FIG. 4.

The phonemic piece data stored in the read only memory 2 are processed sequentially and combined, while the random access memory 4 is being used as the temporary memory of the data, under the controlling operation of the control unit 2 to be controlled by the voice producing program stored in the read only memory 3 in accordance with the operation indicating signal coming from the operation indicating unit 2 so as to thereby composite the digital signals of the desired voice.

Then, the digital signal is converted into the analogue signal by the D/A converter 5. The unnecessary high frequency signals are removed by a low-pass filter not shown. The voice signal is amplified by the amplifier 6. The desired voice signal is provided through the driving operation of the speaker 7.

Figure 5B:
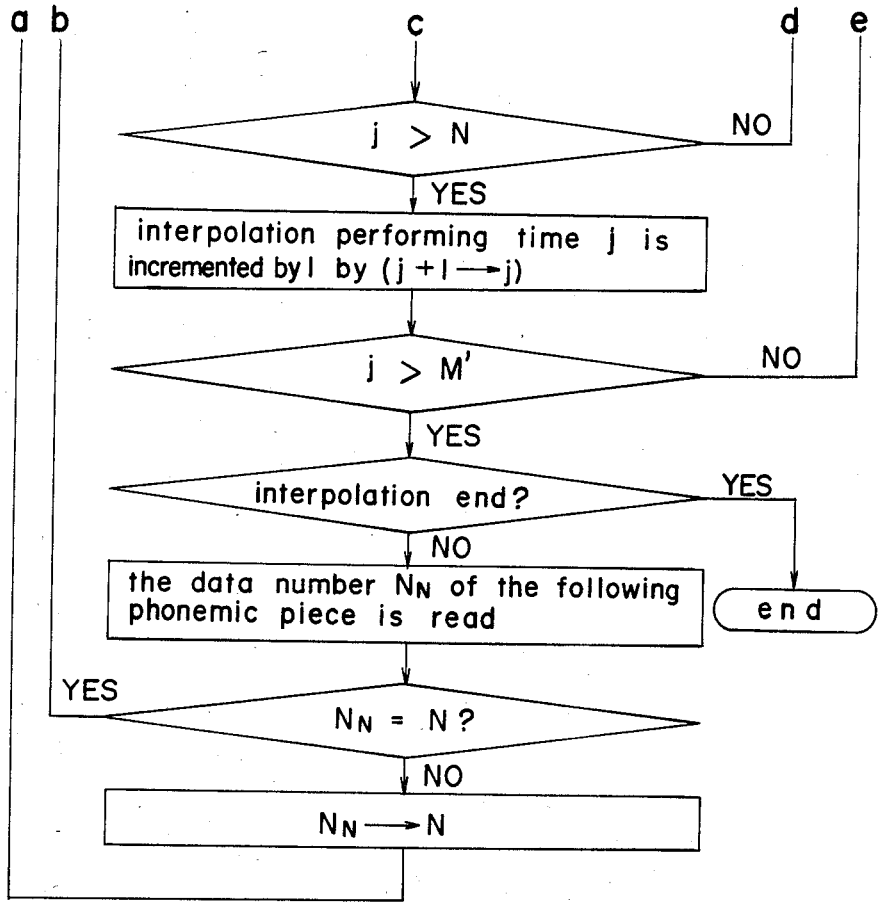
FIG. 5 including FIGS. 5(*a*) and 5(*b*) is a flow chart showing one embodiment of the composing procedure of a voice signal by the interpolation in the apparatus of FIG. 4.
Figure 5:
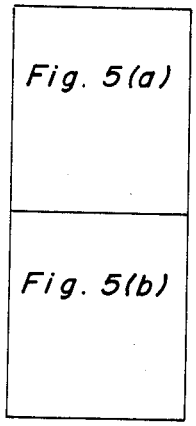
Figure 5:
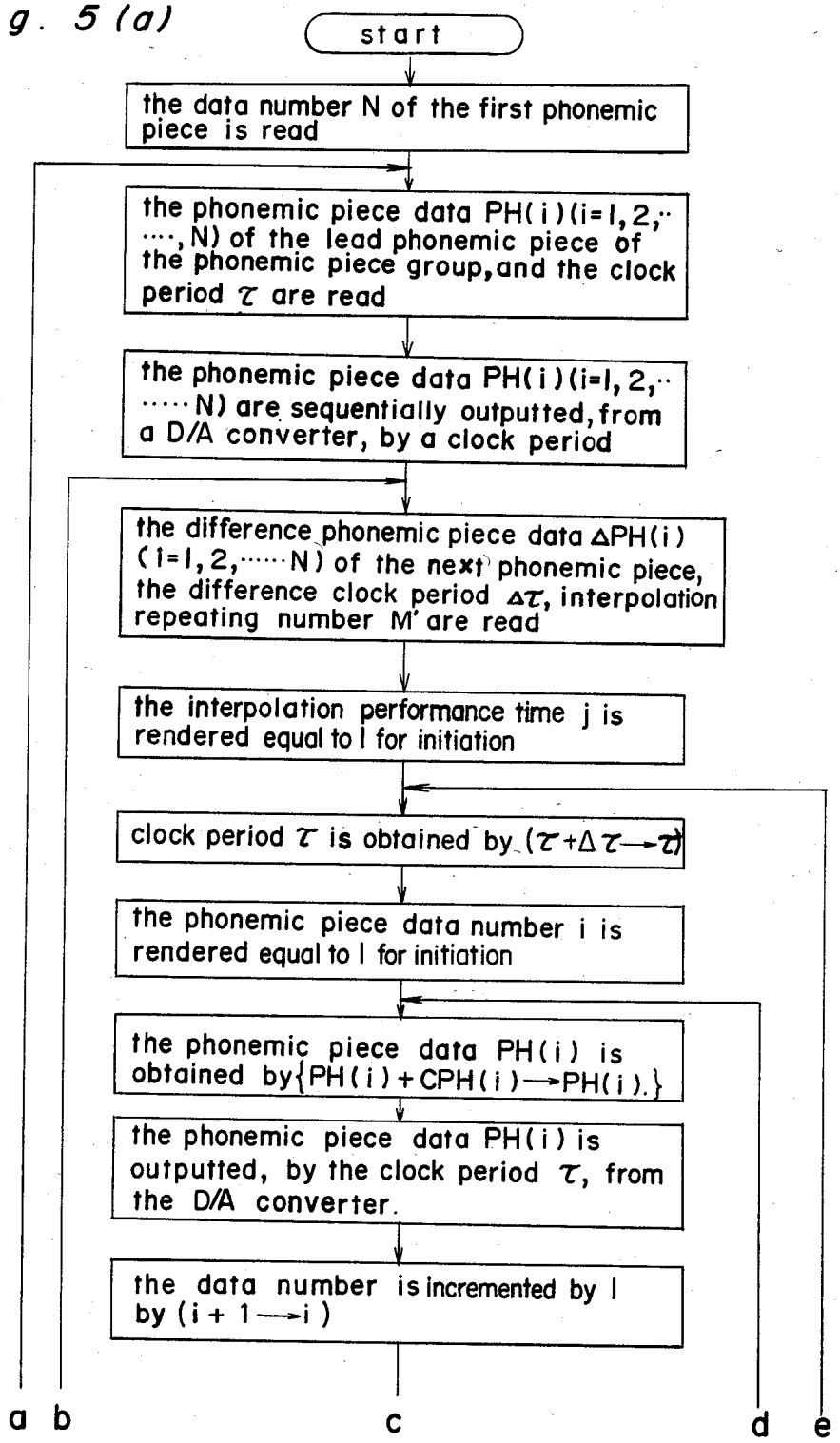

FIG. 5 is a flow chart showing one example of the composing procedure of the voice signal through the interpolation of the voice composing apparatus by the voice analysis composing method of the present invention.

This flow chart is one in a case where the data of the interpolation phonemic piece and the clock period are both obtained by the linear interpolation method.

As described hereinabove, according to the present invention, the smooth, natural voice can be composed by the waveforms of the phonemic piece and the interpolation of the pitch. Also, the phonemic piece which can be replaced by the interpolation method becomes unnecessary through the interpolating operation. Accordingly, the capacity of the memory for the phonemic piece data use can be rendered smaller, thus realizing the compact voice composing apparatus. Since the voice analysis composing method in accordance with the present invention can be realized by a voice composing apparatus having a simple controlling circuit such as general-purpose micro-computer, a higher sound-quality or an inexpensive voice composing apparatus can be provided by a simple construction. Also, if time occupied by the micro-computer is used in the other applications, extremely rational household-use electric appliances, business apparatuses, terminal apparatuses, educational apparatuses, games, toys, etc. can be realized, using not only the voice output functions, but also a high-degree judgment, control function of the micro-computers.

Although the present invention has fully been described in connection with the preferred embodiments thereof with reference to the accompanying drawings, it is to be noted that various changes and modification are apparent to those skilled in the art. Such changes and modifications are to be understood as included within the scope of this invention unless they depart therefrom.

What is claimed is:

1. A voice analysis and composing method comprising a voice analysis method including:

(a) a step of rendering a data number of phonemic data equal to a given data number in a phonemic piece for interpolation between two phonemic pieces;

(b) a step of composing phonemic piece data of the interpolation phonemic piece, by an interpolation operation, from the same data number value of the phonemic piece data of the phonemic piece preceding the phonemic piece to be interpolated and the succeeding phonemic piece;

(c) a step obtaining a phonemic piece data string of a phonemic piece group including the interpolation phonemic piece through insertion of the honemic piece data of said interpolation phonemic piece into the phonemic piece data of the phonemic piece data to be interpolated;

(d) a step of obtaining a difference phonemic piece data string through provision of the difference of the same-number data value of the adjacent phonemic piece data of said phonemic piece data string;

(e) a step of storing, in a memory, the lead phoenic piece data of said phonemic piece data string, and said difference phonemic piece data string, and a voice composing method including:

(f) a step of sequentially adding the difference phonemic piece data, read from said memory, to the lead phonemic piece data of the phonemic piece data string read from said memory so as to thereby obtain the phonemic piece data strings of the phonemic piece group including the interpolation phonemic pieces;

(g) a step of effecting the interpolation operation from the clock period of the phonemic piece preceding said phonemic piece to be interpolated and the clock period of the succeeding phonemic piece so as to thereby produce the clock period of the interpolation phonemic piece;

(h) a step of inserting the clock period of said interpolation-phonemic piece into the clock period of the phonemic piece to be interpolated to obtain the clock period strings of the phonemic piece group including the interpolation phonemic pieces, and (i) a step of outputting, by said clock period string, the phonemic piece data string of the phonemic piece group including said interpolation phonemic pieces.

2. A voice analysis and composing method comprising a voice analysis method including:

(a) a step of rendering a data number of phonemic piece data equal to a given data number in a phonemic piece for interpolation between two phonemic pieces;

(b) a step of storing, in a memory, a value wherein 1 has been added to the number of the interpolation phonemic piece to be inserted between the phonemic pieces to be interpolated, the lead phonemic piece data of the phonemic piece to be interpolated, a difference phonemic piece data provided through division, by a value wherein 1 has been added to the number of said interpolation phonemic piece, of the difference of the same-number of data value of the phonemic piece data of the preceding phonemic piece and the succeeding phonemic piece of said phonemic pieces to be interpolated, the phonemic piece data of the interpolation phonemic piece to be inserted into between the phonemic pieces to be interpolated being adapted to be produced by the linear interpolation, and a voice composing method including:

(c) a step of sequentially adding the difference phonemic piece data read from said memory, to the lead phonemic piece data of the phonemic piece data read from said memory by the number of a value which is greater by one than the number of the interpolation phonemic pieces read from said memory so as to thereby obtain the phonemic piece data string of the phonemic piece group including the interpolation phonemic pieces;

(d) a step of effecting the interpolation operation from the clock period of the preceding phonemic piece of said phonemic pieces to be interpolated and the clock period of the succeeding phonemic piece so as to thereby produce the clock period of the interpolation phonemic pieces;

(e) a step of inserting the clock period of said interpolation phonemic piece into the clock period of the phonemic piece to be interpolated thereby to obtain the clock period strings of the phonemic piece group including the interpolation phonemic pieces, and (f) a step of outputting the phonemic piece data strings of the phonemic piece group including said interpolation phonemic pieces by said clock period string.

3. A voice analysis and composing method comprising a voice analysis method including:

(a) a step of rendering a data number of phonemic piece data equal to a given data number in a phonemic piece for interpolation between two phonemic pieces;

(b) a step of producing interpolation phonemic piece data, by the interpolation operation, from the same-number of data value of the phonemic piece data of the preceding phonemic piece and the succeeding phonemic piece of the phonemic pieces to be interpolated;

(c) a step of inserting the phonemic piece data of said interpolation phonemic pieces into the phonemic piece data of said phonemic pieces to be interpolated so as to obtain the phonemic piece data strings of the phonemic piece group including the interpolation pieces;

(d) a step of effecting the interpolation operation from the phonemic piece clock period of the preceding phonemic piece of said phonemic pieces to be interpolated and the clock period of the phonemic piece thereof so as to thereby produce the clock period of the interpolation phonemic piece;

(e) a step of inserting the clock period of said interpolation phonemic piece into said clock period of the phonemic piece to be interpolated so as to thereby obtain the clock period strings of the phonemic piece group including the phonemic pieces;

(f) a step of providing the difference of the adjacent clock periods of said clock period string so as to thereby obtain the difference clock period string;

(g) a step of storing, in a memory, the lead clock period of said clock period string and said difference clock period string, and a voice composing method including:

(h) a step of sequentially adding the difference clock period read from said memory to the lead clock period of the clock period string read from said memory so as to thereby obtain the clock period string of the phonemic piece group including the interpolation phonemic pieces, and (i) a step of outputting the phonemic piece data string of the phonemic piece group including said interpolation phonemic pieces.

4. A voice analysis and composing method comprising a voice analysis method including:

(a) a step of rendering a data number of phonemic piece data equal to a given data number in a phonemic piece for interpolation between two phonemic pieces;

(b) a step of effecting the interpolation operation from the same-number of data value of the phonemic piece data of the preceding phonemic piece of the phonemic pieces to be interpolated and the succeeding phonemic piece thereof so as to thereby produce the phonemic piece data of the interpolation phonemic piece;

(c) a step of inserting the phonemic piece data of said interpolation phonemic piece into said phonemic piece data of the phonemic pieces into said phonemic piece data of the phonemic pieces to be interpolated so as to thereby obtain the phonemic piece data string of the phonemic piece group including the interpolation phonemic pieces;

(d) a step of storing, in a memory, a value which is greater by one than the number of the interpolation phonemic pieces to be inserted among the phonemic pieces to be interpolated, the clock period of the lead phonemic pieces of said phonemic pieces to be interpolated, and a difference clock period provided through division, by a value which is greater by one than the number of said interpolation phonemic pieces, of the difference between the clock period of the preceding phonemic piece of said phonemic pieces to be interpolated and the clock period of the succeeding phonemic piece thereof, the clock period of said interpolation phonemic piece being composed of linear interpolation, and a voice composing method including:

(e) a step of sequentially adding the difference clock period read from said memory to the clock period of the lead phonemic period of the phonemic pieces to be interpolated read from said memory by the number of a value which is greater by one than the number of the interpolation phonemic pieces read from said memory so as to thereby obtain the clock period string of the phonemic piece group including the interpolation phonemic pieces, and (f) a step of outputting, by said clock period string, the phonemic piece data string of the phonemic piece group including said interpolation phonemic pieces.

5. A voice analysis and composing method comprising a voice analysis method including:

(a) a step of rendering a data number of phonemic piece data equal to a given data number in a phonemic piece for interpolation between two phonemic pieces;

(b) a step of producing the phonemic piece data of the interpolation phonemic pieces, by the interpolation operation, from the same-number of data value of the phonemic piece data of the preceding phonemic piece of the phonemic pieces to be interpolated and the succeeding phonemic piece thereof;

(c) a step of inserting the phonemic piece data of said phonemic piece, to which the phonemic piece data of said interpolation phonemic piece is to be interpolated thereby to obtain the phonemic piece data string of the phonemic piece group including the interpolation phonemic pieces;

(d) a step of providing the difference of the same-number of data value of the adjacent phonemic piece data of said phonemic piece data string;

(e) a step of storing, in memory, the lead phonemic piece data of said phonemic piece data string and said difference phonemic piece data string;

(f) a step of effecting the interpolation operation from the clock period of the lead phonemic piece of said phonemic pieces to be interpolated and the clock period of the succeeding phonemic piece so as to thereby produce the clock period of the interpolation phonemic piece;

(g) a step of inserting the clock period of said interpolation phonemic piece into the clock period of said phonemic piece to be interpolated to obtain the clock period string of the phonemic piece group including the interpolation phonemic pieces;

(h) a step of obtaining the difference of the adjacent clock periods of said clock period string to obtain the difference clock period string;

(i) a step of storing, in a memory, the lead clock period of said clock period string and said difference clock period string, and a voice composing method including:

(j) a step of sequentially adding the difference phonemic piece data, read from said memory, to the lead phonemic piece data of the phonemic piece data string read from said memory to provide the phonemic piece data string of the phonemic piece group including the interpolation phonemic pieces, (k) a step of sequentially adding the difference clock period, read from said memory, to the lead clock period of the clock period string read from said memory thereby to obtain the clock period string of the phonemic piece group including the interpolation phonemic pieces, and (L) a step of outputting, by said clock period string, the phonemic data string of the phonemic piece group including said interpolation phonemic piece.

6. A voice analysis and composing method comprising a voice analysis method including:

(a) a step of rendering a data number of phonemic piece data equal to a given data number in a phonemic piece for interpolation between two phonemic pieces;

(b) a step of producing the phonemic piece data of the interpolation phonemic pieces, by the interpolation operation, from the same-number of data value of the phonemic piece data of the preceding phonemic piece of the phonemic pieces to be interpolated and the succeeding phonemic piece thereof;

(c) a step of inserting the phonemic piece data of said phonemic piece, to which the phonemic piece data of said interpolation phonemic piece is to be interpolated, to obtain the phonemic piece data string of the phonemic piece group including the interpolation phonemic pieces;

(d) a step of providing the difference of the same-number of data value of the adjacent phonemic piece data of said phonemic piece data string to obtain the difference phonemic piece data string;

(e) a step of storing, in a memory, the lead phonemic piece data of said phonemic piece data string and said difference phonemic piece data string;

(f) a step of storing, in a memory, a value which is greater by one than the number of the interpolation phonemic pieces to be inserted among the phonemic pieces to be interpolated, the clock period of the lead phonemic piece of said phonemic pieces to be interpolated, and a difference clock period provided through divison, by a value which is greater by one than the number of said interpolation phonemic pieces, of the difference between the clock period of the preceding phonemic piece of said phonemic pieces to be interpolated and the clock period of the succeeding phonemic piece thereof, the clock period of said interpolation phonemic piece being composed of linear interpolation, and a voice composing method including:

(g) a step of sequentially adding the difference phonemic piece data, read from said memory, to the lead phonemic piece data of the phonemic piece data string read from said memory to provide the phonemic piece data string of the phonemic piece group including the interpolation phonemic pieces;

(h) a step of sequentially adding the difference clock period read from said memory to the clock period of the lead phonemic period of the phonemic pieces to be interpolated read from said memory by the number of a value which is greater by one than the number of the interpolation phonemic pieces read from said memory thereby to obtain the clock period string of the phonemic piece group including the interpolation phonemic pieces, and (i) a step of outputting, by said clock period string, the phonemic piece data string of said phonemic piece group including said interpolation phonemic pieces.

7. A voice signal and composing method of varying, for each of phonemic piece groups, a given data number of a phonemic piece data, comprising a voice analysis method including:

(a) a step of rendering a data number of a phonemic piece data equal to the given data number in the phonemic piece for interpolation between two phonemic pieces;

(b) a step of producing the phonemic piece data of the interpolation phonemic pieces, by the interpolation operation, from the same-number of data value of the phonemic piece data of the preceding phonemic piece of the phonemic pieces to be interpolated and the succeeding phonemic piece thereof;

(c) a step of inserting the phonemic piece data of said phonemic piece, to which the phonemic piece data of said interpolation phonemic piece is to be interpolated, to obtain the phonemic piece data string of the phonemic piece group including the interpolation phonemic pieces;

(d) a step of effecting the interpolation operation from the clock period of the preceding phonemic piece of said phonemic pieces to be interpolated and the clock period of the succeeding phonemic piece so as to thereby produce the clock period of the interpolation phoenic piece;

(e) a step of inserting the clock period of said interpolation phonemic piece into the clock period of said phonemic piece to be interpolated to obtain the clock period string of the phonemic piece group including the interpolation phonemic pieces, and a voice composing method including:

(f) a step of outputting, by said clock period string, the phonemic piece data string of the phonemic piece group including said interpolation phonemic piece.

8. A voice analysis and composing method of varying, for each of phonemic piece groups, a given data number of a phonemic piece data, comprising a voice analysis method including:

(a) a step of rendering a data number of the phonemic piece data equal to the given data number in the phonemic piece for for interpolation between two phonemic pieces;

(b) a step of producing the phonemic piece data of the interpolation phonemic pieces, by the interpolation operation, from the same-number of data value of the phonemic piece data of the preceding phonemic piece of the phonemic pieces to be interpolated and the succeeding phonemic piece thereof;

(c) a step of inserting the phonemic piece data of said phonemic piece, to which the phonemic piece data of said interpolation phonemic piece is to be interpolated, to obtain the phonemic piece data string of the phonemic piece group including the interpolation phonemic pieces;

(d) a step of providing the difference of the same-number of data value of the adjacent phonemic piece data of said phonemic piece data string to obtain the difference phonemic piece data string;

(e) a step of storing, in a memory, the lead phonemic piece data of said phonemic piece data string and said difference phonemic piece data string, and a voice composing method including:

(f) a step of sequentially adding the difference phonemic piece data, read from said memory, to the lead phonemic piece data of the phonemic piece data string read from said memory to provide the phonemic piece data string of the phonemic piece group including the interpolation phonemic pieces;

(g) a step of effecting the interpolation operation from the clock period of the preceding phonemic piece of said phonemic pieces to be interpolated and the clock period of the succeeding phonemic piece so as to thereby produce the clock period of the interpolation phonemic piece;

(h) a step of inserting the clock period of said interpolation phonemic piece into the clock period of said phonemic piece to be interpolated to obtain the clock period string of the phonemic piece group including the interpolation phonemic pieces;

(i) a step of outputting, by said clock period string, the phonemic piece data string of the phonemic piece group including said interpolation phonemic piece.

9. A voice analysis and composing method of varying, for each of phonemic piece groups, a given data number of a phonemic piece data, comprising a voice analysis method including:

(a) a step of rendering a data number of a phonemic piece data equal to the given data number in the phonemic piece for interpolation between two phonemic pieces;

(b) a step of producing the phonemic data of the interpolation phonemic pieces, by the interpolation operation, from the same-number of data value of the phonemic piece data of the preceding phonemic piece of the phonemic pieces to be interpolated and the succeeding phonemic piece thereof;

(c) a step of inserting the phonemic piece data of said phonemic piece, to which the phonemic piece data of said interpolation phonemic piece is to be interpolated, to obtain the phonemic piece data string of the phonemic piece group including the interpolation phonemic pieces;

(d) a step of effecting the interpolation operation from the clock period of the preceding phonemic piece of said phonemic pieces to be interpolated and the clock period of the succeeding phonemic piece thereby to produce the clock period of the interpolation phonemic piece;

(e) a step of inserting the clock period of said interpolation phonemic piece into the clock period of said phonemic piece to be interpolated to obtain the clock period string of the phonemic piece group including the interpolation phonemic pieces;

(f) a step of providing the difference of the adjacent clock periods of said clock period string thereby to obtain the difference clock period string;

(g) a step of storing, in a memory, the lead clock period of said clock period string and said difference clock period string, and a voice composing method including:

(h) a step of sequentially adding the difference clock period, read from said memory, to the lead clock period of the clock period string read from said memory thereby to obtain the clock period string of the phonemic piece group including the interpolation phonemic pieces, and (i) a step of outputting the phonemic piece data string of the phonemic piece group including said interpolation phonemic pieces.

10. A voice analysis and composing method of varying, for each of phonemic piece groups, a given data number of phonemic piece data, comprising a voice analysis method including:

(a) a step of rendering the data number of the phonemic piece data equal to the given data number in the phonemic piece for interpolation between two phonemic pieces;

(b) a step of producing the phonemic piece data of the interpolation phonemic pieces, by the interpolation operation, from the same-number of data value of the phonemic piece data of the preceding phonemic piece of the phonemic pieces to be interpolated and the succeeding phonemic piece thereof;

(c) a step of inserting the phonemic piece data of said phonemic piece, to which the phonemic piece data of said interpolation phonemic piece is to be interpolated, to obtain the phonemic piece data string of the phonemic piece group including the interpolation phonemic pieces;

(d) a step of providing the difference of the same-number of data value of the adjacent phonemic piece data of said phonemic piece data string to obtain the difference phonemic piece data storing;

(e) a step of storing, in memory, the lead phonemic piece data of said phonemic piece data string and said difference phonemic piece data string;

(f) a step of effecting the interpolation operation from the clock period of the preceding phonemic piece of said phonemic pieces to be interpolated and the clock period of the succeeding phonemic piece so as to thereby produce the clock period of the interpolation phonemic piece;

(g) a step of inserting the clock period of said interpolation phonemic piece into the clock period of said phonemic piece to be interpolated to obtain the clock period string of the phonemic piece group including the interpolation phonemic pieces;

(h) a step of providing the difference of the adjacent clock periods of said clock period string thereby to obtain the difference clock period string, (i) a step of storing, in a memory, the lead clock period of said clock period string and said difference clock period string, and a voice composing method including:

(j) a step of sequentially adding the difference phonemic piece data, read from said memory, to the lead phonemic piece data of the phonemic piece data string read from said memory to provide the phonemic piece data string of the phonemic piece group including the interpolation phonemic pieces, (k) a step of sequentially adding the difference clock period, read from said memory, to the lead clock period of the clock period string read from said memory thereby to obtain the clock period string of the phonemic piece group including the interpolation phonemic pieces, and (L) a step of outputting, by said clock period string, the phonemic piece data string of the phonemic piece group including said interpolation phonemic pieces.

* * * * *